United States Patent [19]

Okabayashi et al.

[11] 4,148,007

[45] Apr. 3, 1979

[54] SERIAL-INDICATION FAULT DISPLAY SYSTEM FOR VEHICLES

[75] Inventors: Shigeru Okabayashi; Kousaku Baba, both of Yokohama; Hiroshi Endō, Yokosuka, all of Japan

[73] Assignee: Nissan Motor Company, Limited, Japan

[21] Appl. No.: 867,039

[22] Filed: Jan. 5, 1978

[30] Foreign Application Priority Data

Jan. 13, 1977 [JP] Japan ..... 52-1894

[51] Int. Cl.[2] ..... G08B 19/00

[52] U.S. Cl. ..... 340/52 F; 340/378.3; 340/518; 340/522

[58] Field of Search ..... 340/52 F, 324 B, 325, 340/373, 377, 378 R, 379, 517, 518, 520, 521, 522; 307/10 R

[56] References Cited

U.S. PATENT DOCUMENTS

| | | | |
|---|---|---|---|
| 3,541,550 | 11/1970 | Hanre | 340/52 F X |
| 3,835,450 | 9/1974 | Reck | 340/52 F |
| 3,882,492 | 5/1975 | McSorley et al. | 340/518 |
| 3,916,375 | 10/1975 | Sumiyoshi et al. | 340/52 F |
| 4,088,980 | 5/1978 | Tanigawa et al. | 340/52 F |

*Primary Examiner*—John W. Caldwell, Sr.
*Assistant Examiner*—Joseph E. Nowicki
*Attorney, Agent, or Firm*—Lane, Aitken & Ziems

[57] ABSTRACT

A fault indication signal from a plurality of sensors is used to advance a rotary switch to hunt in search of the terminal at which the signal appears. The terminals of the switch are associated with the corresponding visual fault indications recorded on an endless film mounted on a transport mechanism that is driven in unison with the rotary switch. Upon the occurrence of a second fault, the switch is again triggered to advance in search of the terminal where the second signal appears for successive indication of the second fault location. The switch is automatically stepped to a terminal where a signal indicating the presence of more than one fault appears for permanent indication of the number of such faults. The system can be restarted manually to provide successive indications of the first and second faults to facilitate troubleshooting.

11 Claims, 2 Drawing Figures

11
#1
#2
#3
#4
#5
#6
#7
#8
#9
#10
#11
30
31
32
25
26
29
27
28
17
19
18
21
20
NO FAULT
PLURALITY
FROM POWER STAGE 77
16
14
13
15
12
22
23
24
10
79
85

SERIAL-INDICATION FAULT DISPLAY SYSTEM FOR VEHICLES

BACKGROUND OF THE INVENTION

The present invention relates generally to warning systems, and in particular to a fault display system in which visual fault indications are serially displayed on a one-at-a-time basis in response to the occurrence of warning signals from strategically located sensors.

The serial type fault display system is known in the art and advantageously employed in applications such as vehicles where space is at a premium. However, the simultaneous occurrence of more than one failure presents difficulty in calling the driver's attention to the faulty conditions without losing his attention to on-coming vehicles since such failures must be indicated at certain length of intervals. One approach would be to present the fault indication of a first occurrence, then the indication of the second occurrence only after the previous faulty component has been removed. However, the driver is not aware of the fact that there is more than one faulty component in the vehicle at the same time.

SUMMARY OF THE INVENTION

An object of the invention is to provide a serial type fault display system which directs the driver's attention to the simultaneous occurrences of more than one failure without losing his attention to on-coming vehicles by giving the indication of the locations of failures in succession followed by the indication of the number of failures being detected.

In accordance with the invention, an endless film tape having a series of fault indications is supported on a transport mechanism which is operatively associated with a rotary switch having the same number of terminals as the fault indications so that the advancement of the rotary switch from one terminal to another corresponds to the advancement of one fault indication to another in the transport mechanism. Output signals from the sensors are summed up and then compared with reference levels to determine the number of faulty locations. It is necessary to provide information as to whether there is more than one faulty location. No fault indication is also provided. The switch terminals comprise a first plurality of sense terminals connected to the output of the corresponding sensors and a second sense terminal connected to receive the fault number signal indicating the simultaneous occurrence of more than one fault so that the first terminals represent the location of the fault and the second terminal represents the plurality of such faults. The switch is driven by a control circuit which responds to the fault signal from the sensors to advance the switch to the terminal associated with the sensor which has signaled to the control circuit. Upon occurrence of a second fault, the control circuit automatically responds to the second signal to advance the switch until it reaches the terminal associated with the second fault location where it stays for a predetermined interval and then automatically advances to the second sense terminal to indicate the presence of a plurality of faults. The system can be manually checked by the driver with a start switch that causes the rotary switch to advance to hunt the sense voltages in succession to permit successive indications of the faulty locations and then return to the second terminal where it remains as long as the faults are present.

BRIEF DESCRIPTION OF THE DRAWINGS

The invention will be further described with reference to the accompanying drawings, in which.

DETAILED DESCRIPTION

Figure 1:
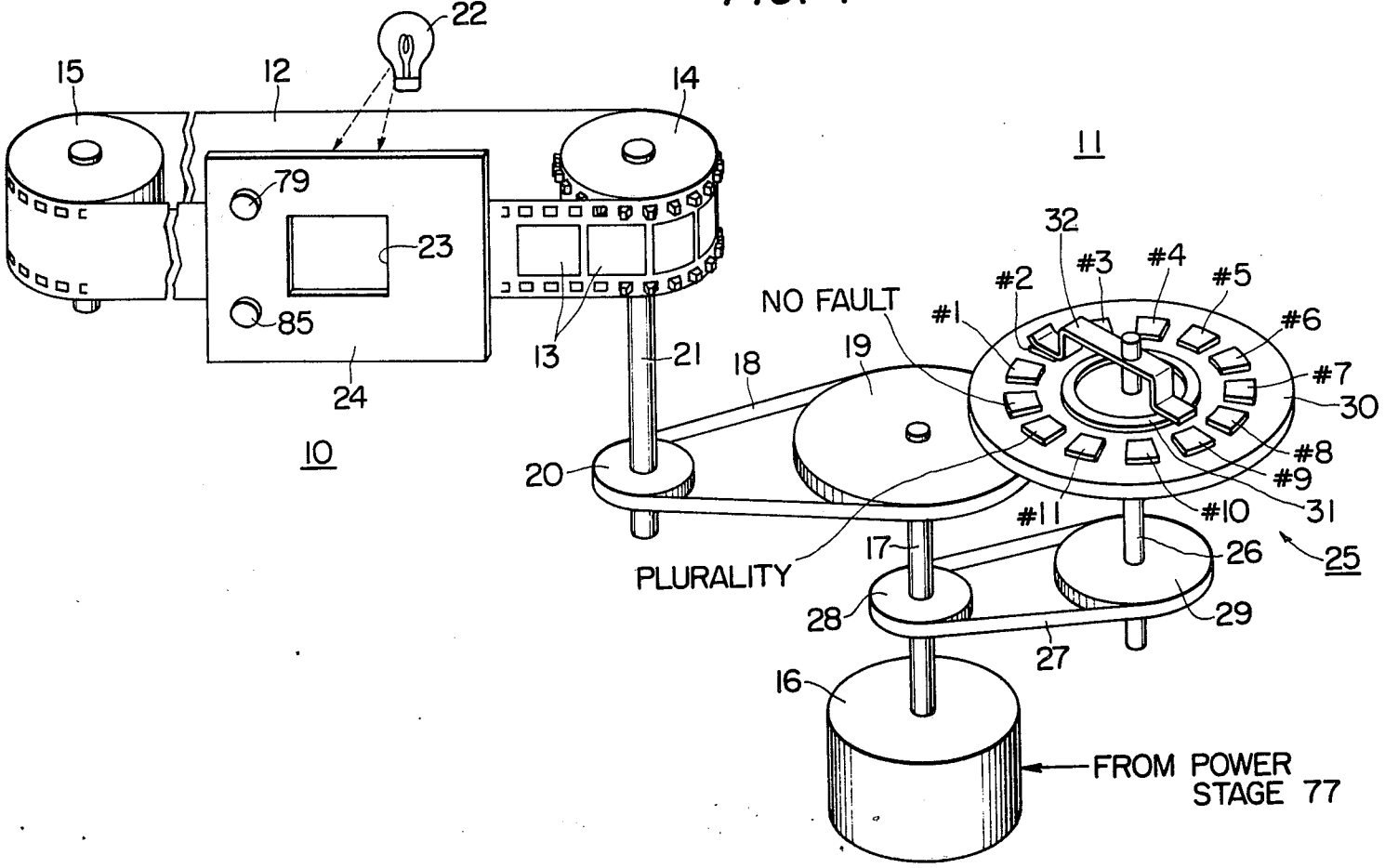
FIG. 1 is a perspective view of the fault indication mechanism and the rotary switching mechanism of the invention.
Figure 2:
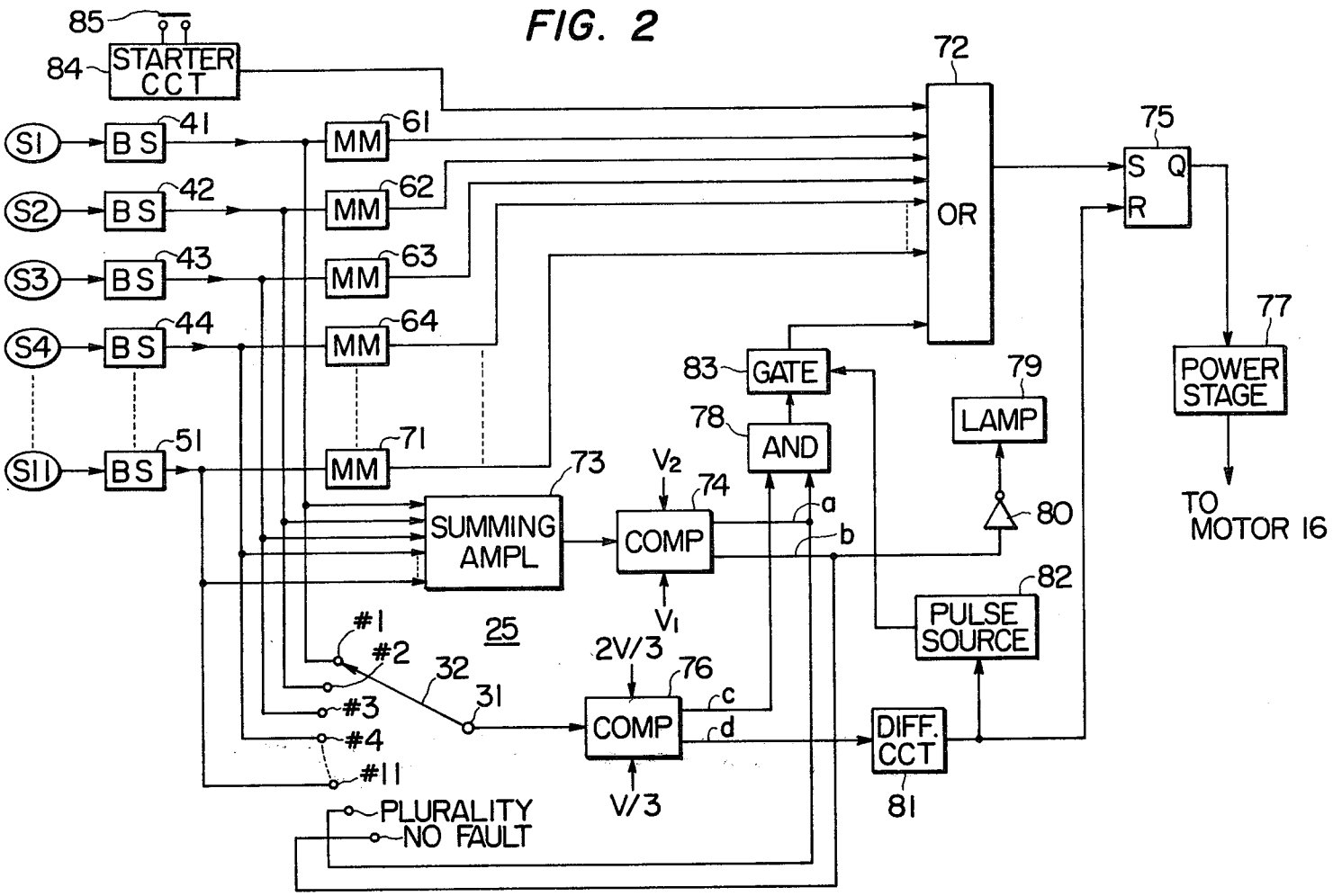
FIG. 2 is a circuit block diagram of the control circuit that controls the operation of the indication and switching mechanisms of FIG. 1.

The display system of the present invention represented in FIG. 1 comprises a fault display mechanism 10 and a control system 11 which is connected to an electronic sensing and control system shown in FIG. 2. The display mechanism 10 comprises an endless tape of film 12 having a series of frames 13 in which are photographically recorded respective visual information representing the location of various points being monitored within a motor vehicle to indicate the place of failure when that occurs and other indications including no faulty condition and simultaneous occurrence of more than one failure. The film tape is mounted on a pair of sprockets 14, 15 which are operative to be driven by a motor 16 through a linkage including motor shaft 17, belt 18 supported on pulleys 19 and 20, the latter being mounted on shaft 21 coupled to the sprocket 14. As will be described hereinbelow, the motor 16 is energized in response to an input signal to transport the film to illuminate the visual information recorded therein with light rays provided by source 22 when a desired frame is positioned in window 23 of a display panel 24 which may be mounted on the instrument panel of the vehicle.

The control system 11 includes a rotary switch 25 with the shaft 26 connected to the motor shaft 17 by means of a belt 27 supported on pulleys 28, 29 on shafts 17, 26, respectively. The rotary switch 25 may be any one of conventional types which include a plurality of voltage sense terminals located circumferentially on an insulative support 30, a contact ring 31, and a contact arm 32 mounted on shaft 26 for making electrical contact between the ring 31 and a selected one of the voltage sense terminals. These terminals comprise failure location indicating terminals designated by No. 1 through No. 11 and failure state indication terminals designated by characters NO FAULT and PLURALITY, the latter indicating that there is more than one faulty area in the vehicle. As shown in FIG. 2, terminals No. 1 through No. 11 are electrically connected to the output terminals of respective buffer storage devices 41 through 51 connected to respective sensors S1 to S11 strategically located around the vehicle to supply information on the operating condition of the headlamps, tail lamps, tire pressure, and so forth.

The outputs of the buffer storage devices are further connected on the one hand via respective monostable multivibrators 61 through 71 to an OR gate 72 and on the other hand to a summation amplifier 73 whose output is connected to a comparator 74.

Each of the buffer storage devices delivers a voltage signal with an amplitude V in response to the output from the respective sensor upon detection of a failure. Upon occurrence of a failure, the output voltage V from a buffer storage device is applied to a respective terminal of the rotary switch 25. Each of the monostable multivibrators is of a leading edge triggered type to provide an output pulse in response to the detection of the failure to the set terminal of flip-flop 75 via the OR gate 72. As long as a failure is present the corresponding terminal of the switch 25 is biased at a voltage V which will be sensed by a comparator 76 connected to the ring terminal 31 of the switch 25 when the contact arm 32 comes into contact with the corresponding sense terminal.

The input signal from the OR gate 72 sets the flip-flop 75 into a Q high output condition which is amplified by a power stage 77 to set the motor 16 in motion. Film tape 12 and rotary switch 25 are driven upon energization of motor 16 until the contact arm 32 reaches the corresponding terminal where a sense voltage V appears.

Summing amplifier 73 provides summation of the amplitudes of input voltage signals and applies a summation output to the comparator 74 for comparison with voltages $V_1$ and $V_2$ to determine whether the input voltage falls within a predetermined range. The voltage references $V_1$ and $V_2$ are so selected that $V_1$ is smaller than voltage V and $V_2$ is greater than V so that if the summation output falls between reference levels $V_1$ and $V_2$, the comparator 74 recognizes that the number of failures is one and provides a logic "0" on output connections a and b. If no failure is present, the comparator will provide a logic "0" to output connection a and a voltage signal with an amplitude half as much as voltage V to output connection b. When the input voltage exceeds the higher level $V_2$, comparator 74 is designed to deliver a logic "0" to output connection b and a voltage V/2 to output connection a. The connection a of the comparator 74 is connected to an AND gate 78 and to PLURALITY terminal of the switch 25, the connection b being connected to an indicating lamp 79 via a NOT circuit 80 and also to NO FAULT terminal. The lamp 79 is mounted on the display panel 24 to alert the driver when a failure has occurred. Since the output connection b of the comparator 74 is at logic "0" level for the input level exceeding voltage level $V_1$, the lamp 79 will be lit when at least one sensed area should fail.

The comparator 76, on the other hand, is designed to compare the failure indicating voltage V which appears on one of the terminals No. 1 to No. 11 and the sense voltage V/2 which appears on one of the NO FAULT and PLURALITY terminals with reference levels 2V/3 and V/3. This comparator will provide a high level output or V/2 on output connection c to AND gate 78 when the input level is above the higher voltage level 2V/3, and a high level output on output connection d to a differentiating circuit 81 when the input level is above the lower reference level V/3.

The differentiator 81 will thus be energized when the contact arm 32 is brought into contact with the terminal where an error indicating voltage V appears. The differentiated signal is used to reset the flip-flop 75 to terminate motor energization so that the rotary switch is stopped as soon as the failure indicating voltage is sensed and film 12 is stopped with the corresponding frame being positioned within the panel window 23 to be illuminated to give visual indication of the location of the failed area.

A pulsing source 82 is shown connected to differentiator 81 which energizes source 82 to generate timing pulses at 2-second intervals, for example. This timing pulse will be applied to OR gate 72 and hence to flip-flop 75 via a gate 83 when the latter is enabled by the output of AND gate 78. If there is only one failure in the vehicle, the gate 83 will no longer be enabled so that the timing pulse is prevented from being applied to flip-flop 75. On the other hand, if there is more than one failure, AND gate 78 has been enabled by the high level output on the output connection a of comparator 74 and ready to pass to the control terminal of gate 83 a high level output which appears on connection c when comparator 76 senses the presence of the failure indicating voltage V. The gate 83 is thus activated only when more than one failure has occurred simultaneously to pass the timing pulse to the set terminal of flip-flop 75 so that the motor 16 will be energized again to advance the rotary switch 25 as well as the indication mechanism 10 a setp further. The motor energization will be continued until the switch 25 comes to a terminal position where the comparator 76 senses the presence of another failure indicating voltage V to provide a high voltage output on connections c and d, whereupon the differentiator 81 is energized resetting the flip-flop 75. The pulse source 82 is energized again to generate a second timing pulse after the elapse of two seconds so that the film 12 stays in the same position for two seconds to indicate the location of the second failure. Therefore, the driver's attention is brought to the fact that two failures have occurred simultaneously. After the elapse of the two-second period, the second timing pulse will trigger the flip-flop 75 into the set condition to energize the motor again to advance the rotary switch to the PLURALITY terminal since the latter is supplied with a sense voltage V/2 from comparator 74 at this time so that a high voltage output will appear at connection d to reset flip-flop 75 de-energizing motor 16. Since no high voltage output is present on connection c at this time, AND gate 78 is no longer activated so that a third timing pulse is inhibited from passing the gate 83 to flip-flop 75 to prevent the motor from being energized. Therefore, a plurality-of-failure indication is given until the display system is manually reset again as described below after the successive indications of the respective locations of the failures.

It is thus understood that for single failure conditions the location of the failure is indicated continually and for a-plurality-of-failures conditions the locations of the failures are successively indicated and then switched to the indication of the simultaneous occurrence of more than one failure.

The display system can be reset in response to the activation of starter circuit 84. This starter circuit is manually activated by a switch 85 mounted on the display panel 24 to set the flip-flop 75 via OR gate 72 regardless of at what terminal the rotary switch 25 is positioned. When no failure is present in the vehicle, the activation of the start switch 85 will cause the rotary switch to start hunting the terminals until comparator 76 senses the presence of a voltage V/2 appearing on NO FAULT terminal. A high voltage signal is generated on lead d of the comparator to energize the differentiator 81 to reset the flip-flop 75, thus de-energizing the motor 16.

The resetting operation will, in the presence of more than one failure, give the driver successive indications of the failed locations again to permit him to remember the locations of interest. In the other conditions, the rotary switch will be caused to rotate in response to the resetting operation until its contact arm comes to the previous terminal position.

Assuming that a third failure has occurred with the display indicating a plurality-of-failures condition, the rotary switch 25 will be automatically set in motion again by the third failure indicating signal applied through OR gate 72 to hunt in search of the third failure indicating voltage in addition to the previous failure indicating voltages. Therefore, it will be understood that the first, second and third failures are successively indicated automatically, and the rotary switch is again stopped to the PLURALITY position, but, of course, the failure indication is not necessary in this order because of the serial access of the rotary switch to the voltage sense terminals.

The starter switch 85 may be operatively associated with an ignition switch of the vehicle so that the operation of the latter energizes the starter circuit 84 to allow the driver to check if there is any faulty location in the vehicle before it is started.

What is claimed is:

1. A fault display system for motor vehicles, comprising in combination:

a plurality of sensors located in a vehicle, each sensor providing a first signal in response to the detection of a predetermined sensed condition of a vehicle component being monitored;

first voltage sensing means connected to said sensors for generating a second signal representative of the presence of at least two of such sensed conditions;

a plurality of first voltage sense terminals associated with said sensors to receive said first signals on respective terminals and a second voltage sense terminal connected to receive said second signal;

second voltage sensing means selectively connected to said sense terminals for detecting the presence of said first and second signals on said terminals;

means for visually indicating a selected one of a plurality of visual representations corresponding to said first and second terminals;

drive means for driving said visual indicating means for selectively displaying one of said visual representations and driving said second voltage sensing means in association with said visual indicating means for selective connection to said sense terminals; and drive control means responsive to the occurrence of said first signal from a said sensor for energizing said drive means and responsive to the detection of a said first signal on said voltage sense terminal associated with said sensor for de-energizing said drive means to allow said indicating means to display said visual representation associated with said terminal, said drive control means including timing means for re-energizing said drive means after the elapse of a predetermined interval in response to the detection of the lastmentioned first signal in the presence of said second signal, said timing means being inhibited in response to the detection of said second signal on said second voltage sense terminal to allow said indicating means to display a visual representation associated with said second terminal.

2. A fault display system as claimed in claim 1, wherein said first voltage sensing means includes means for generating a third signal representative of the absence of said predetermined sensed condition, further comprising a third voltage sense terminal connected to receive said third signal and arranged to be connected to said second voltage sensing means, said second voltage sensing means including means for detecting the presence of said third signal on said third sense terminal, said visual indicating means further including an additional visual representation associated with said third sense terminal for indicating the absence of said predetermined sensed condition, said drive control means being responsive to the detection of said third signal for de-energizing the energized drive means to allow said visual indicating means to display said additional visual representation.

3. A fault display system as claimed in claim 1, further including a plurality of buffer storage devices, each connected to the output of a respective one of said sensors.

4. A fault display system as claimed in claim 3, further comprising means connected to the output of each of said buffer storage devices for generating a pulse at the leading edge of the output from said buffer storage device, said pulse being supplied to said drive control means.

5. A fault display system as claimed in claim 1, wherein said drive control means includes a bistable device, a differentiator connected to said second voltage sensing means, a pulse generating means responsive to the output of the differentiator for generating a pulse at predetermined intervals, and a gate control circuit responsive to the detection of said first signal on said first sense terminal in the presence of said second signal for passing said generated pulse to said bistable device to allow same to assume a first binary state, said bistable device being responsive to the output of said differentiator to assume a second binary state, the output of said bistable device being a signal for energization of said drive means.

6. A fault display system as claimed in claim 2, wherein said second voltage sensing means comprises a rotary switch having said voltage sense terminals circumferentially located on an insulative support, and wherein said first sense terminals are arranged in sequence and said second and third sense terminals are arranged in sequence.

7. A fault display system as claimed in claim 1, wherein said visually indicating means comprises an endless film tape including a series of said visual representations, a display panel having a window in which each of said visual representation is disposed for illumination.

8. A fault display system as claimed in claim 1, further comprising a start circuit including a manually operated switch to provide a start pulse to said drive control means to cause same to energize said drive means.

9. A fault display system as claimed in claim 8, wherein said manually operated switch is mounted on said visually indicating means.

10. A fault display system as claimed in claim 9, wherein said manually operated switch is operable in association with an ignition switch of a motor vehicle.

11. A fault display system as claimed in claim 1, further comprising a lamp mounted on said visually indicating means for indicating the presence of said predetermined condition in response to the presence of said first signal.

* * * * *